US006776557B2

(12) United States Patent
Barnat et al.

(10) Patent No.: US 6,776,557 B2
(45) Date of Patent: Aug. 17, 2004

(54) ROADWAY PAVING SUPPLY TRUCK

(75) Inventors: James J. Barnat, Wichita, KS (US); Patrick O'Brien, Oregon, IL (US); Harold Dabbs, Mt. Morris, IL (US); Jeremy Heller, Dixon, IL (US); Thomas R. Brown, Oregon, IL (US); Tyrone Hannebaum, Rockford, IL (US)

(73) Assignee: E.D. Etnyre & Co., Oregon, IL (US)

( * ) Notice: Subject to any disclaimer, the term of this patent is extended or adjusted under 35 U.S.C. 154(b) by 0 days.

(21) Appl. No.: 10/235,871

(22) Filed: Sep. 4, 2002

(65) Prior Publication Data

US 2003/0012601 A1 Jan. 16, 2003

Related U.S. Application Data

(62) Division of application No. 09/873,800, filed on Jun. 4, 2001.

(51) Int. Cl.[7] ..... E01C 19/12

(52) U.S. Cl. ..... 404/101; 404/108; 404/404; 404/111

(58) Field of Search ..... 404/101, 111, 404/90, 91, 108; 299/39; 222/74, 617, 622; 414/527, 528, 657, 662, 674; 298/23

(56) References Cited

U.S. PATENT DOCUMENTS

| | | | | |
|---|---|---|---|---|
| 971,338 A | | 9/1910 | Adams | |
| 1,158,503 A | | 11/1915 | Johnston | |
| 1,242,558 A | | 10/1917 | Johnston | |
| 1,912,897 A | | 6/1933 | Huet | |
| 3,260,176 A | * | 7/1966 | Bowers | 404/111 |
| 3,902,666 A | | 9/1975 | Ito et al. | |
| 4,124,325 A | * | 11/1978 | Cutler | 404/75 |
| 4,315,700 A | | 2/1982 | Heiligtag et al. | |
| 4,423,980 A | | 1/1984 | Warnock | |
| 4,529,622 A | | 7/1985 | Maxfield | |
| 4,678,363 A | | 7/1987 | Sterner | |
| 4,765,772 A | | 8/1988 | Benedetti et al. | |
| 4,818,139 A | | 4/1989 | Brock et al. | |
| 4,838,598 A | * | 6/1989 | Hyde | 296/50 |
| 4,856,931 A | | 8/1989 | Bollag | |
| 4,948,431 A | | 8/1990 | Strickland et al. | |
| 4,974,993 A | | 12/1990 | Crabbi | |
| 5,000,615 A | | 3/1991 | Murray | |
| 5,029,927 A | * | 7/1991 | Totani | 296/50 |
| 5,039,557 A | | 8/1991 | White | |
| 5,069,578 A | | 12/1991 | Bense et al. | |
| 5,079,095 A | | 1/1992 | Reed et al. | |
| 5,153,026 A | | 10/1992 | Reed et al. | |
| 5,178,486 A | | 1/1993 | Perrin et al. | |

(List continued on next page.)

FOREIGN PATENT DOCUMENTS

| | | |
|---|---|---|
| EP | 0442593 A1 | 2/1991 |
| EP | 0478441 A1 | 4/1992 |

*Primary Examiner*—Thomas B. Will
*Assistant Examiner*—Raymond W. Addie
(74) *Attorney, Agent, or Firm*—Leydig, Voit & Mayer, Ltd.

(57) ABSTRACT

A roadway paving system for chipsealing a roadway surface comprising a novel roadway paving vehicle and a novel supply truck is provided. The roadway paving vehicle comprises an asphalt binder material dispensing system and an aggregate material dispensing system. The asphalt binder material dispensing system includes an asphalt tank and a sprayer that sprays a first layer of the asphalt binder material over the roadway surface. The aggregate material dispensing system comprises an aggregate hopper and conveyor mechanism that discharges a second layer of aggregate material over the roadway surface. No wheels run over a freshly laid surface. Supply trucks are linked to the roadway paving vehicle to refill the roadway paving vehicle on a continuous basis without the need of stopping the vehicle.

8 Claims, 7 Drawing Sheets

U.S. PATENT DOCUMENTS 5,182,137 A 1/1993 Allen
5,190,400 A * 3/1993 Sterner ..... 404/103
5,234,128 A 8/1993 Hill
5,251,999 A * 10/1993 McCracken ..... 404/109
5,279,500 A 1/1994 Perrin et al.
5,405,440 A 4/1995 Green et al.
5,439,313 A 8/1995 Blaha et al.
5,544,972 A 8/1996 Boldt
5,590,976 A 1/1997 Kilheffer et al.
5,735,634 A 4/1998 Ulrich et al.
5,741,085 A 4/1998 Wirtgen
5,752,782 A * 5/1998 Hulicsko ..... 404/103
5,895,173 A 4/1999 O'Brien et al.
5,911,362 A 6/1999 Wood et al.
5,971,657 A * 10/1999 Medico et al. ..... 404/92
5,988,935 A * 11/1999 Dillingham ..... 404/79
6,007,419 A * 12/1999 Bessire ..... 454/118
6,079,901 A 6/2000 Banks et al.
6,099,616 A 8/2000 Jenne et al.
6,345,931 B1 2/2002 Capece
6,386,818 B1 5/2002 Reed
6,444,258 B1 9/2002 Terry

* cited by examiner

ROADWAY PAVING SUPPLY TRUCK

This is a division of application Ser. No 09/873,800 filed Jun. 4, 2001.

FIELD OF THE INVENTION

The present invention relates generally to the asphalt pavement industry and, more particularly, relates to apparatus and methods of surfacing and resurfacing roadways or other pavement surfaces.

BACKGROUND OF THE INVENTION

Roadway surfaces are usually paved. In the construction of new roadways, pavement is typically applied to an unpaved base after it has been graded and compacted. Over time, existing roadways inevitably become worn and in need of repair. For example, cracks can develop in the roadway surface, and/or the surface can become overly smooth. If cracks develop, the surface is no longer water resistant, and the roadway will deteriorate at an accelerated pace. If the surface becomes overly smooth, the skid resistance and traction for vehicles are diminished.

A common practice for maintaining roadway surfaces is through a practice known as "chipsealing". Current chipsealing processes utilize an asphalt distributor vehicle for applying asphalt binder material (e.g., liquid asphalt, emulsified asphalt, molten bituminous material, asphalt binder material, etc.) and a subsequent chipspreader vehicle for distributing aggregate material (e.g. gravel, sand, crushed stone, recycled glass, etc.). Thus, in practice, chipsealing is performed by two separate vehicles making two separate passes over the same portion of the roadway in order to apply a single layer of pavement to that portion.

Chipsealing is a relatively fast and inexpensive technique for surfacing or resurfacing a roadway. However, presently-employed chipsealing processes have several deficiencies as will be detailed below.

The surface produced by the binder and the stone is often desired to be about one stone thick. In practice, however, additional stone is applied beyond what is required to produce a layer one stone thick in order to keep the tires of the chipspreader from picking up stones off the freshly laid surface. This results in extra stone being required which is expensive from a materials standpoint. In normal operation, the application process is stopped and restarted quite often in order to re-supply stone and asphalt binder to the process. Stopping and restarting usually creates a bump or flaw in the surface, which is often unacceptable for high volume traffic, thus often limiting application of the chipsealing process to low volume traffic applications.

Another problem with two separate machines is that it is difficult to properly control the time between the application of the asphalt binder and the aggregate material. It is necessary to control proper spacing between the asphalt distributor vehicle and the chipspreader vehicle. If the timing is not closely controlled or there is a problem with one vehicle, the binder can begin to set or cure before the aggregate is applied. This reduces the effectiveness of the binder in holding the aggregate to the road surface and may cause dislodging of stones by subsequent traffic.

BRIEF SUMMARY OF THE INVENTION

It is a primary objective to provide a solution to the stopping and restarting problems associated with current chipsealing processes which can cause bumps or flaws in a finished road surface.

It is another objective of the present invention to provide a chipsealing apparatus and method that may reduce the amount of aggregate material needed to effect the desired surfacing or re-surfacing of a roadway surface.

It is another objective of the present invention to provide a chipsealing apparatus and method that may operate at a maximum speed that is at least substantially the same as current chipsealing processes or is otherwise economically feasible.

In accordance with these and other objectives, the present invention is directed toward a novel roadway paving vehicle that may be used for chipsealing paving operations. It comprises both an asphalt binder material dispensing system and an aggregate material system on the same apparatus. The asphalt binder material and aggregate material are not mixed inside the apparatus prior to discharge. The roadway paving vehicle has an engine and wheels with opposed front and rear ends. The aggregate material dispensing system comprises an input hopper disposed proximate the front end of the vehicle that receives aggregate material, an output hopper disposed proximate the rear end of the vehicle, and a conveyor mechanism extending between the input hopper and the output hopper. The conveyor mechanism transports aggregate material from the input hopper to the output hopper. The output hopper converges toward a discharge port to discharge aggregate material over the ground surface. The asphalt binder material dispensing system comprises a tank for holding asphalt binder material, a spray bar between the discharge port and the front end, and a pump mechanism adapted to pump asphalt binder material from the tank to the spray bar. The spray bar has a plurality of nozzles that spray the asphalt binder material.

The present invention is also directed toward a method of chipsealing a roadway surface with a roadway paving vehicle. The method comprises storing a supply of asphalt binder material in a tank on the roadway paving vehicle; transporting asphalt binder material from the tank to a spray bar at the rear end of the roadway paving vehicle; spraying asphalt binder material from the spray bar at a first span over the roadway surface forming a layer of asphalt binder material on the roadway surface; storing a supply of aggregate material in an input hopper at the front end of the roadway paving vehicle; transporting aggregate material from the input hopper to an output hopper at the rear end of the roadway paving vehicle; discharging aggregate material from the output hopper at a second span over the layer of asphalt binder material; and preventing intermixing of asphalt binder material and aggregate material prior to the discharging of aggregate material and spraying of asphalt binder material.

The present invention is also directed toward a novel supply truck for connection to another vehicle or apparatus. The truck includes a chassis supported on wheels extending between front and rear ends. A supply hopper is supported by the chassis and has a discharge region at the rear end. A conveyor mechanism in the supply hopper conveys aggregate material toward the discharge region. A tailgate closes the discharge region of the supply hopper. The tailgate can move rearwardly relative to the chassis to open the discharge region to allow discharge of aggregate material from the rear end of the supply truck. The supply truck further includes a supply tank carrying liquid material (such as asphalt binder material for example). A transfer conduit is connected to the supply tank and is carried by the tailgate. The transfer conduit includes a hydraulic coupling that extends rearwardly when the tailgate moves rearwardly. It is used to transfer liquid such as binder. It may also support electronic controls if desired.

It is an aspect of the invention to provide a supply truck with a live bottom hopper having a supply tank carrying liquid material in which the supply tank is disposed beneath the conveyor mechanism and the hopper and between the front wheel set and the rear wheel sets, whereby a low center of gravity is provided when the tank is filled with liquid.

It is a further aspect of the present invention to provide a new roadway paving system comprised of a roadway paving vehicle and a supply truck wherein the system may be operated on a continuous basis. This is accomplished with a linking system between the supply truck and roadway paving vehicle. The two vehicles can be linked and unlinked during continuous operation without stopping with the roadway paving vehicle storing sufficient amounts of asphalt binder material and aggregate material on the roadway paving vehicle for application between supply truck changes.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
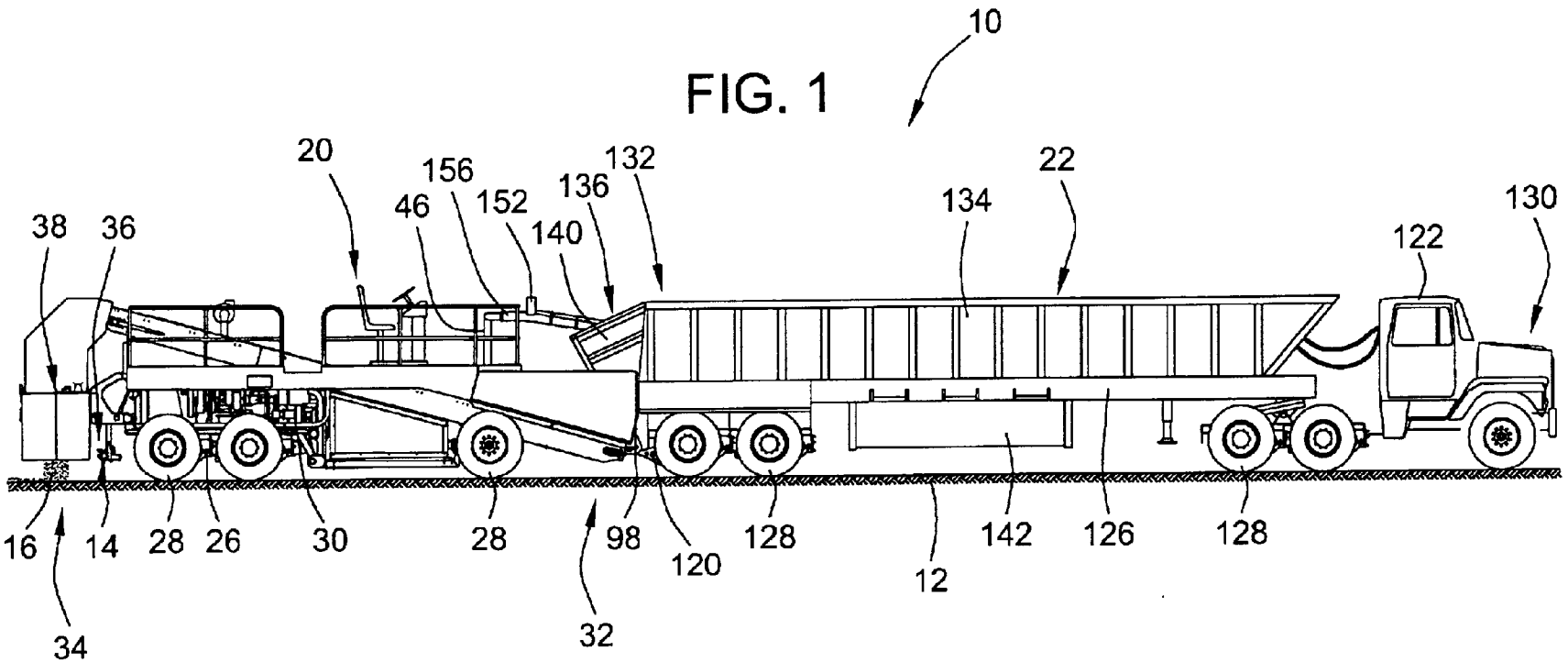
FIG. 1 is side elevation view of a roadway paving system according to a preferred embodiment of the present invention comprising a roadway paving vehicle and a supply truck.
Figure 2:
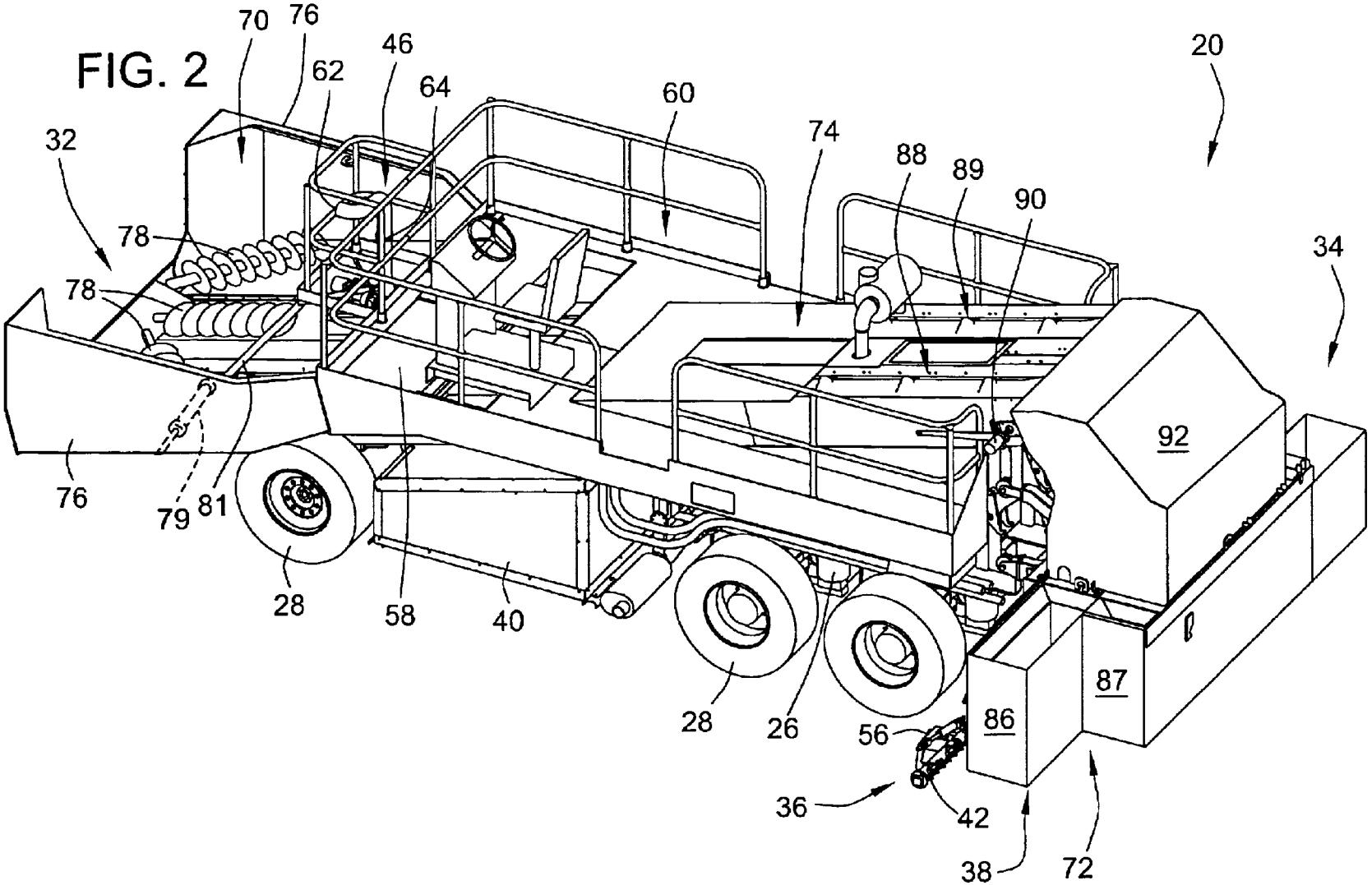
FIG. 2 is an isometric view of the roadway paving vehicle illustrated in FIG. 1.

For purposes of illustration, a preferred embodiment of the present invention is illustrated as an asphalt paving system 10 comprising a novel roadway paving vehicle 20 and a novel supply truck 22 as shown in FIG. 1. The roadway paving vehicle 20 applies asphalt binder material (e.g., liquid asphalt, emulsified asphalt, molten bituminous material, asphalt binder material, binder containing asphalt components, asphalt containing binder, etc.) and aggregate material (e.g. gravel, sand, crushed stone, recycled glass, shell, recycled materials, slag, etc.) typically over an existing paved roadway to "chipseal" the roadway surface, but also could be used for new roadway surfaces. The particular type of asphalt binder material or aggregate material is not important as it will be understood by those skilled in the art that many forms of these materials can be used. These terms are intended to be generic as applied to the industry. The supply truck 22 carries a supply of both asphalt binder material and aggregate material for the purpose of refilling the roadway paving vehicle 20 with materials. In operation, the supply truck 22 links with the roadway paving vehicle 20 on the run meaning that roadway paving vehicle 20 is moving forward and continuously dispensing asphalt binder material and aggregate material while it is being refilled. After the supply truck 22 is empty, the roadway paving vehicle 20 can be linked with another supply truck.

The paving system 10 is primarily used to "chipseal" an existing roadway surface 12 with an asphalt binder layer 14 and an aggregate layer 16 spread on the top of the asphalt binder layer 14. The layers 14, 16 combine to create a new surface over the roadway 12 that provides a water barrier or seal, improves the life-span of the roadway, provides for improved vehicle traction, and/or provides a new wearable layer. Although this disclosure describes two layers 12, 14, it will be appreciated to those skilled in the art that once these layers are deposited on a roadway surface, the layers typically combine integrally and are substantially indistinguishable from one another forming a single stratum of paving material.

Figure 3:
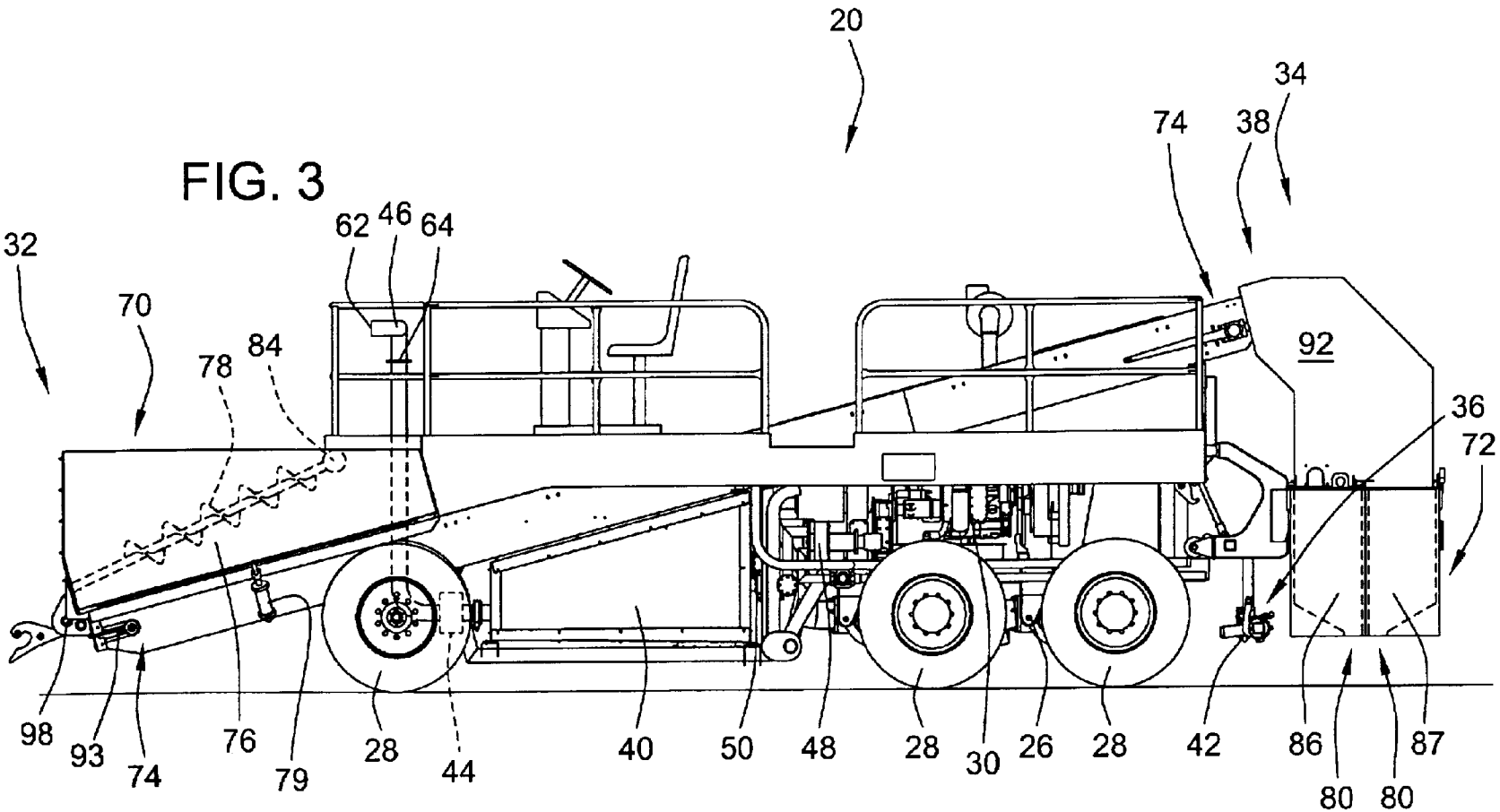
FIG. 3 is a side elevation view of the roadway paving vehicle illustrated in FIG. 2.

Referring to FIGS. 2–5, the roadway paving vehicle 20 comprises a frame or chassis 26 supported on wheels 28 and an engine 30. For purposes of reference, the vehicle 20 includes front and rear ends generally indicated at 32, 34. The vehicle 20 carries an asphalt binder dispensing system 36 that dispenses asphalt binder material and an aggregate material dispensing system 38 that dispenses aggregate material. As generally shown in FIGS. 1 and 3, the asphalt binder dispensing system 36 is separate from the aggregate material dispensing system 38 such that asphalt binder material and aggregate material are not mixed in the vehicle 20 prior to the dispensing of the asphalt binder material and the aggregate material at the rear end 34 of the vehicle. Thus, the aggregate material is discharged without being mixed with asphalt binder inside the vehicle 20. By using a single vehicle 20 carrying both the asphalt binder dispensing system 36 and the aggregate material dispensing system 38, the time and spacing between application of the asphalt binder material and aggregate material can be optimized for best chip embedment and retention. In addition, the dispensing area of the asphalt binder dispensing system 36 and the aggregate material dispensing system 38 are both arranged at the rear end 34 of the vehicle behind all of the supporting wheels 28 such that no wheels roll over freshly laid asphalt binder layer 14 or aggregate layer 16. This prevents the wheels from picking up and throwing stones or damaging the fresh application and may allow fewer chips to be used as extra chips are not necessary to prevent asphalt binder from sticking to the wheels.

In the disclosed embodiment, the asphalt binder dispensing system 36 generally comprises a tank 40, a spray bar 42, an input pump 44, an input conduit 46, an output pump 48 and an output conduit 50. The tank 40 is supported between front and rear wheel sets and contains hot asphalt binder material. The tank 40 is sized large enough to provide a sufficient holding capacity for dispensing asphalt binder material on a continuous basis between changes in supply trucks without the need to stop, thereby avoiding flaws or bumps in the roadway surface. The output pump 48 is fluidically connected to the tank 40 and the spray bar 42 to pump asphalt binder material to the spray bar 42, to form a sprayer. The particular disclosed pump 44 is an asphalt gear pump which may both pump and meter asphalt binder material directly. However, it will be appreciated that other pumps, such as tank pressurizing pumps could be used for example in conjunction with control valves, or other pumping schemes.

Figure 4:
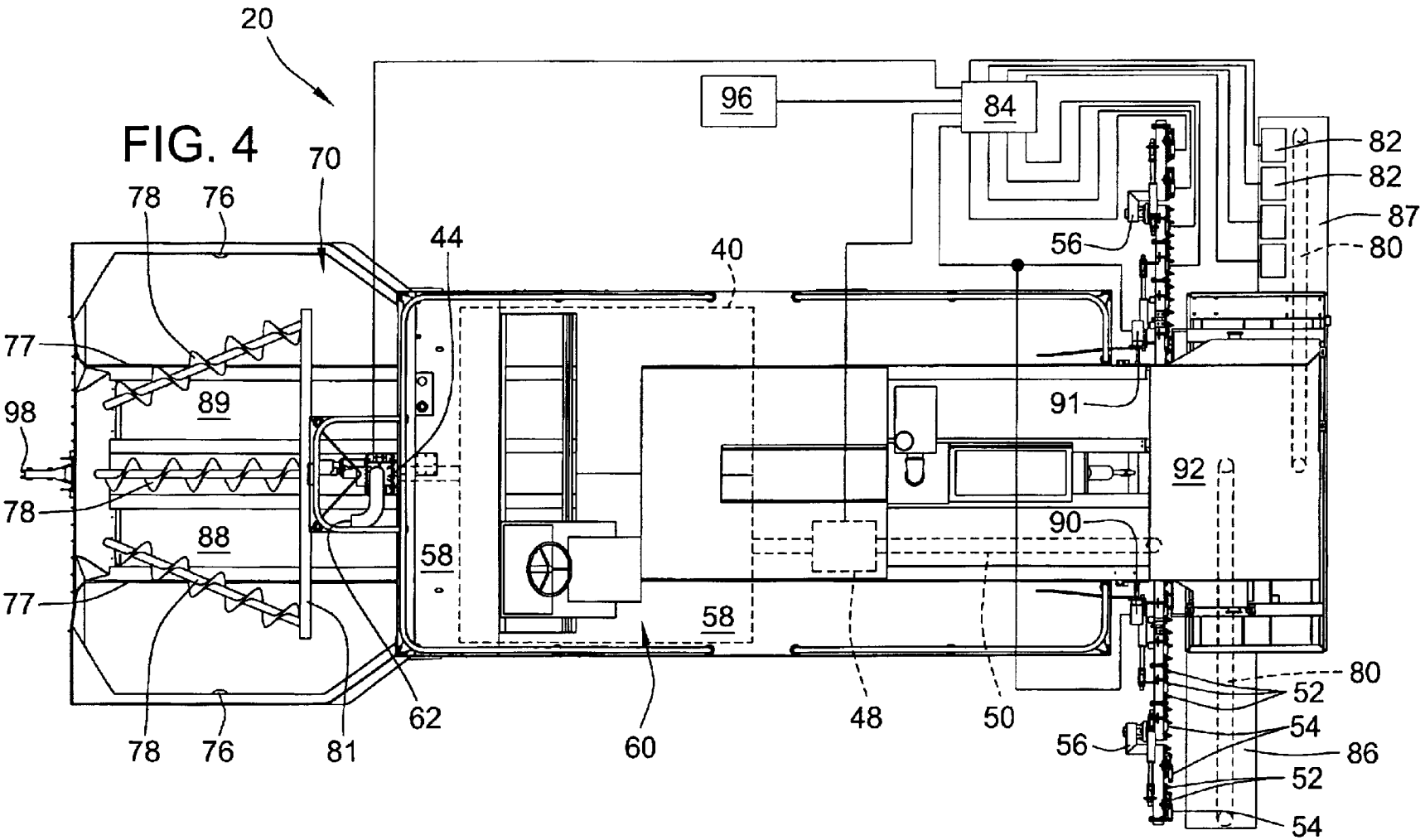
FIG. 4 is a top plan view of the roadway paving vehicle illustrated in FIG. 2 with a partial schematic added to illustrate operational features of the vehicle.
Figure 5:
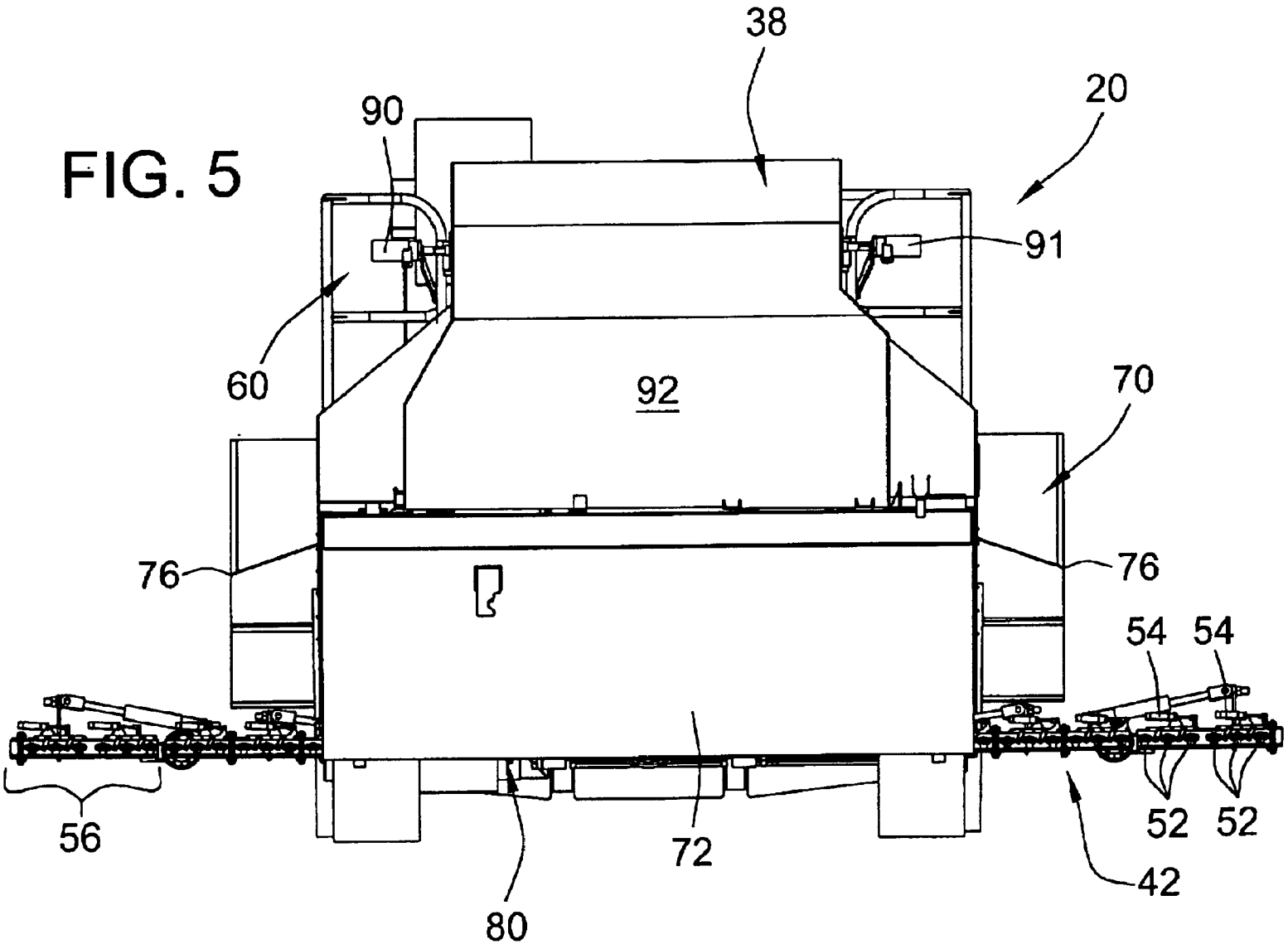
FIG. 5 is a rear end view of the roadway paving vehicle illustrated in FIG. 2.

The spray bar 42 extends horizontally generally parallel to the roadway surface. Referring to FIGS. 4–5, the spray bar 42 is comprised of a plurality of nozzles 52 and a plurality of control valves 54 in series with the nozzles 52. Each control valve 54 controls flow of asphalt binder material to the individual nozzles 52. The control valves 54 have open and closed states for allowing and preventing flow of asphalt binder material to individual nozzles 52. With this arrangement, the span or spray width of asphalt binder material is selectively variable or modular and can be controlled or adjusted by shutting off selected control valves 54.

The spray bar 42 also preferably includes extendible and retractable arms 56. The arms 56 can extend beyond the normal width of the vehicle 20 so as to cover an entire roadway lane. The arms 56 can also retract to be within the normal width of the vehicle 20 for road transport. The extendible and retractable arms 56 are illustrated as the pivoting type, pivoting between raised and lowered positions, but it will be appreciated that horizontally extendible and retractable telescoping arms may also be utilized that horizontal with respect to the roadway.

The disclosed asphalt binder dispensing system 36 also includes a refill system comprised of the input conduit 46 and the input pump 44 for pumping asphalt binder material into the holding tank 40, as shown best in FIGS. 3–4. Preferably the input pump 44 is a gear pump 44 that works through suction rather than pressure to avoid pressurized lines that could otherwise rupture. The input conduit 46 fluidically connects to the holding tank 40 and extends vertically above a platform 58 of an operator station 60 on the vehicle 20 and terminates in a hydraulic coupling 62. The hydraulic coupling 62 is disposed at a convenient vertical height for ready and accessible connection to the asphalt binder supply of the supply truck 22 by the operator stationed on the vehicle's operator station 60. The input conduit 46 preferably includes a swivel joint 64 (including ball joints or other rotatable joints) allowing rotation about the vertical axis to allow an operator to connect the hydraulic coupling 62 to the supply truck 22. The input conduit 46 also extends vertically upwardly through the platform 58 in a centrally accessible location relative to conveyors 88, 89 discussed infra.

The aggregate material dispensing system 38 comprises a storage hopper in the form of an input hopper 70 at the front end 32 of the vehicle and an output hopper 72 at the rear end 34 of the vehicle. The aggregate material dispensing system 38 further includes a conveyor mechanism 74 extending diagonally for transporting aggregate material from the input hopper 70 to the output hopper 72.

The hoppers 70, 72 are sized large enough to provide a sufficient holding capacity for dispensing aggregate material on a continuous basis between changes in supply trucks without the need to stop, thereby avoiding flaws or bumps in the roadway surface. The input hopper 70 may include extendible and retractable extension wings 76 that expand horizontally outward via a fluid powered cylinder outside the normal span of the vehicle 20 to increase the holding capacity of the input hopper 70 and retract within the normal span of the vehicle 20 for over the road transportation. In the disclosed embodiment, each of the wings 76 can be pivoted about hinges 77 by fluid powered cylinders 79 to provide the desired clearance. The disclosed embodiment also includes augers 78 disposed above the conveyor mechanism 74 and mounted between the hopper and a horizontal cross support 81 mounted to the chassis 26. The augers 78 or other such spreaders can be operated to spread out the aggregate material in the input hopper 70 to more fully utilize the holding capacity of the input hopper 70 and wings 76.

The output hopper 72 discharges aggregate material through a discharge port 80 at the bottom thereof as shown best in FIGS. 3–4. The discharge port 80 is divided into separate adjacent sections by a plurality of gates 82 as schematically shown in FIG. 4. (Note: not all control valves, gates or connections with all gates and control valves are shown in FIG. 4). The gates 82 have open and closed states for allowing and preventing discharge of aggregate material. The overall span or width of the applied layer 16 of aggregate material is determined by the gates 82, which can be opened and closed. More gates 82 can be opened to expand the span of discharged aggregate material or closed to decrease the span of discharged aggregate material. Thus the length or span of the discharge port 80 is selectively variable or modular to accommodate different application widths and changes in the width of the roadway surface 12. In practice, the width of the discharged aggregate material is typically equal to or just greater than the width of the discharged asphalt binder material. Aggregate material may be discharged forwardly, rearwardly or both through the discharge port 80. The discharge port may also be divided into multiple horizontally parallel sections with certain sections having a fixed output and other sections having a variable output.

The output hopper 72 is also divided into a pair of horizontally translatable dispensing bins 86, 87 disposed one in front of the other. The bins 86, 87 are contained within the normal span of the vehicle 20 for over the road transportation. However, the bins expand through horizontal movement with respect to the roadway outside the span of the vehicle 20 to expand the overall length of the discharge port 80 sufficient to cover at least an entire lane of a roadway 12 and substantially equivalent to the length of the extended spray bar 42. The dispensing bins 86, 87 and the spray bar 42 can be shifted from side to side or right or left for adjustment as necessary (an off center feature).

As the output hopper 72 may be divided into separate bins 86, 87 as in the disclosed embodiment, similarly, the conveyor mechanism 74 may comprise separate conveyors in the preferred form of endless belt conveyors 88, 89 controlled by motors 90, 91. Although belt conveyors 88, 89 have been illustrated, it will be appreciated that other conveyor mechanisms could also be used, such as augers which may also have holding capacity for aggregate material if large enough. Each belt conveyor 88, 89 feeds aggregate material into the bins 86, 87 through a guide chute 92. Either conveyor can go to either bin 86, 87 or each conveyor can be dedicated to one bin. The diagonal arrangement of the conveyors 88, 89 allows for room for the operator station 60 and platform 58 to be at a relatively high vertical height towards the front end 32 of the vehicle. At the front end 32, the conveyors have a relatively low vertical height. As the conveyors 88, 89 extend rearward and upward, clearance is provided for the tank 40 and engine 30 toward the center and rear end 34 of the vehicle where the conveyors are at a relatively high vertical height.

The spray bar 42 is generally parallel to the discharge port 80 and spaced in front of the discharge port between about 0.1 and about 10 feet. The roadway paving vehicle 20 applies asphalt binder material and aggregate material at a maximum sustainable speed of between about 1 and about 15 miles per hour. During truck refilling, the speed of the vehicle may slow.

To accommodate different vehicle speeds, different application rates, and different widths and thickness of the layers 14, 16 of asphalt binder and aggregate, the paving vehicle 20 includes an electronic controller 84 (either an integral controller or separate controllers) in electrical communication with the control valves 54, the output pump 48, and the gates 82, as schematically indicated in FIG. 4. The electronic controller 84 is responsive to vehicle speed determined by a speed sensor 96 and other operator input. The electronic controller 84 controls these components to set an application rate and width for the asphalt binder material and the aggregate material from one of many of the various application rates and widths available. As the vehicle speed changes, the electronic controller 84 automatically compensates accordingly for uniform application.

Figure 6:
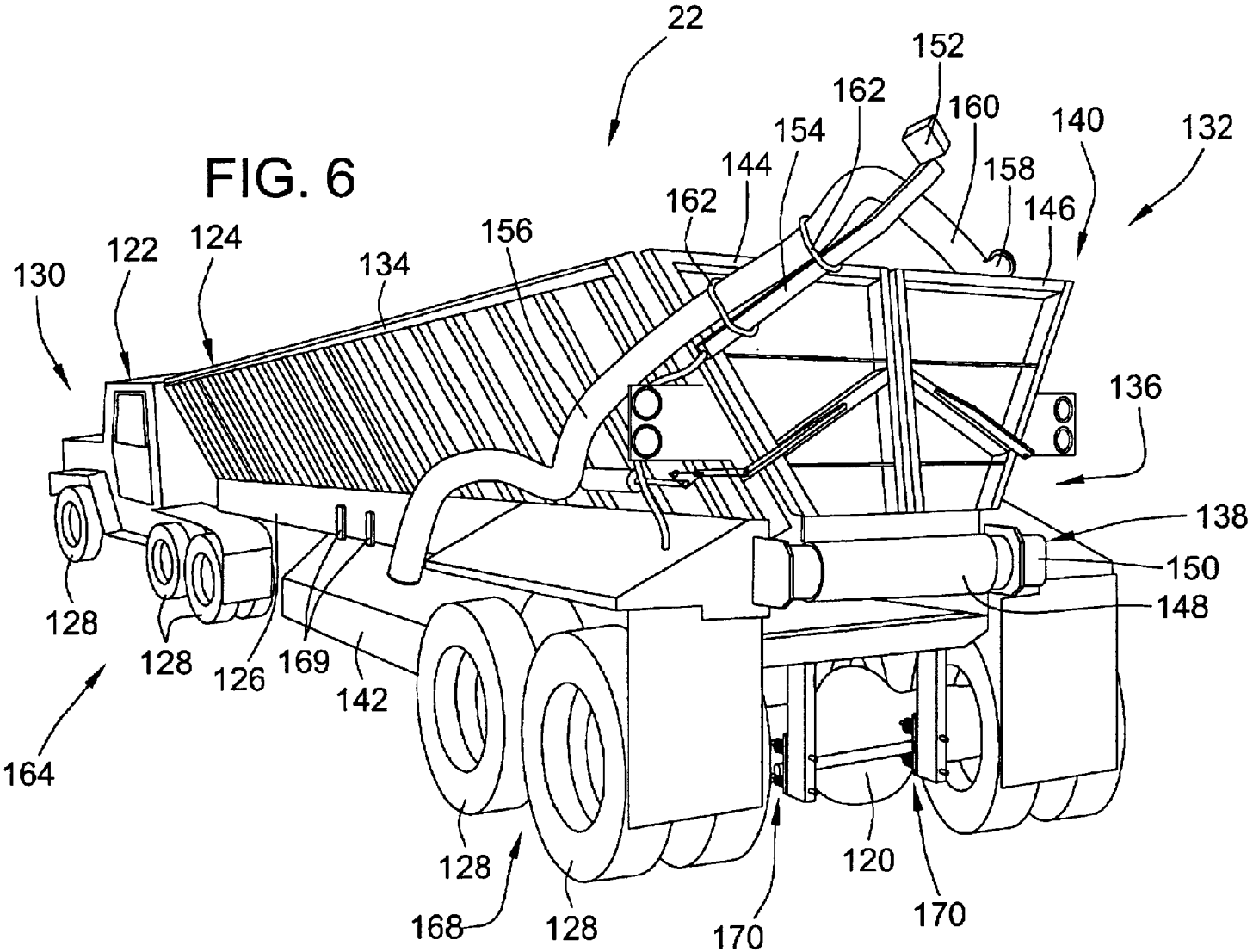
FIG. 6 is a rear end perspective view of the supply truck illustrated in FIG. 1, with the tailgate in a closed position.
Figure 7:
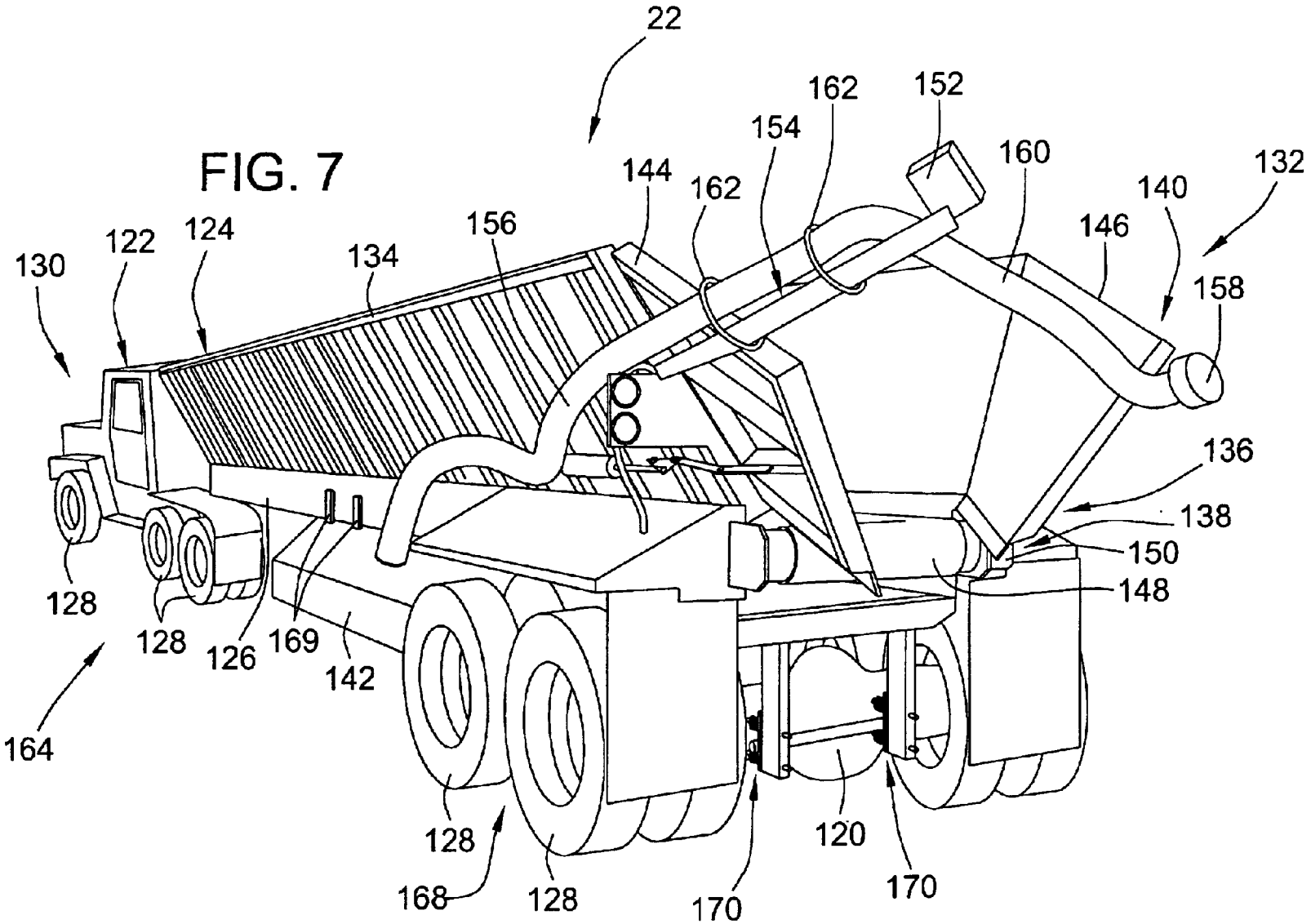
FIG. 7 is the same rear end perspective view of the supply truck shown in FIG. 6 but with the tailgate in an open position.

To better prevent spilling of material during supply truck refilling operations, the roadway paving vehicle 20 also includes a mechanical coupling hook attachment 98 at the front end 32 that releasably couples to a cross bar 120 at the rear end of the supply truck 22, as can be seen in FIGS. 1, 6 and 7. This better ensures proper spacing between the roadway paving vehicle 20 and the supply truck 22. The truck 22 also preferably includes a spring impact mechanism 170 to absorb impact when the speeds of the truck 22 and roadway paving vehicle 20 are being synchronized when linking the two vehicles without stopping the forward progression of the chipsealing operation. The spring impact mechanism 170 allows the cross bar 120 to move forwardly against the action of a spring. The roadway paving vehicle 20 also similarly includes a spring impact mechanism 93 also for absorbing impact. The spring impact mechanism 93 allows the hook attachment to move rearwardly against the action of a spring. Although spring impact mechanisms 93, 170 are illustrated it will be appreciated that other shock absorbers may be used including silicon packing or other resilient members.

Turning in greater detail to the supply truck 22 with reference to FIGS. 1 and 6–7, the supply truck 22 is shown in the form of an over-the-road tractor 122 and a detachable live bottom trailer 124, although a unitary truck can also be used. The truck 22 includes a trailer chassis 126 supported on wheels 128 and extending longitudinally between front and rear ends 130, 132. The chassis 126 supports an elongated supply hopper 134 for holding aggregate material having a discharge region 136 at the rear end 132. A conveyor mechanism 138 in the supply hopper 134 can convey aggregate material toward the discharge region 136. A tailgate 140 closes the discharge region 136 of the supply hopper 134 to prevent material from escaping and opens rearwardly to allow for material to be discharged. The supply truck 22 is also equipped with a supply tank 142 containing asphalt binder material.

When the supply truck and roadway paving vehicle are linked, aggregate material can be transferred from the supply truck 22 to the input hopper 70 through the discharge region 136. The tailgate 140 is comprised of horizontally outwardly pivoting doors 144, 146 that control and direct the discharge of aggregate material. Further details of the outwardly pivoting doors are described in U.S. patent application Ser. No. 09/572,636, the entire disclosure of which is hereby incorporated by reference. Suffice it to say that the doors 144, 146 pivot rearward and away from each other to open the discharge region 136 and forwardly and toward each other to close the discharge region 136.

The supply truck 22 is illustrated as the "live bottom" type with the conveyor mechanism 138 comprising an endless belt 148 entrained around sprockets and driven by motor 150. The motor 150 has a variable speed such that the discharge rate of aggregate material is controllable. It is an aspect of the invention that the speed of motor 150 and therefore the conveyor mechanism 138 is controlled at the operator station 60 on the roadway paving vehicle 20. In the disclosed embodiment, this is accomplished with an electronic control module 152 of the supply truck 22 that extends to the paving vehicle 22. The control module 152 is in electrical communication with the motor 150. In this manner, the refill rate of aggregate material into the input hopper 70 is controlled from the roadway paving vehicle 20. The operator of the paving vehicle 20 can control refilling and prevent an overfill condition as the input hopper is in clear sight.

In the disclosed embodiment, the electronic control module 152 is actually part of the supply truck 22. Specifically, the electronic control module 152 is carried by the tailgate 140 and extends rearward to the operator station 60 on the roadway paving vehicle 20 when the tailgate 140 opens rearwardly. More specifically, the electronic control module 152 is carried on the end of a support arm 154 affixed to one of the outwardly pivoting doors 144. The support arm 154 extends diagonally and upwardly positioning the electronic control module 152 above the doors 144, 146 so that when the doors extend rearwardly, the electronic control module 152 extends to the operator station 60 for ready access and use by an operator on the roadway paving vehicle 20.

Asphalt binder material is transferred from the supply truck 22 to the roadway paving vehicle 20 via a transfer conduit in the form of a flexible transfer hose 156. The flexible transfer hose 156 has one end connected to the supply tank 142 and the other end terminating in a hydraulic coupling 158. When the tailgate 140 extends rearwardly, the flexible transfer hose 156 and hydraulic coupling 158 also extend rearwardly to the operator station 60 for attachment with the asphalt binder dispensing system 36 of the roadway paving vehicle 20. In the disclosed embodiment, the transfer hose 156 is supported by the support arm 154 and extends beyond the end of the arm 154 to provide a flexible end portion 160 for easy manipulation. The end portion 160 may be latched to the truck hopper 134 for transport. The transfer hose 156 extends diagonally and upwardly generally parallel with support arm 154 being secured thereto by cables or chains 162. When the doors 144, 146 extend rearward to open the discharge region 136, the transfer hose 156 extends rearward to the operator station for connection to the vertically extending input conduit 46. The hydraulic coupling 158 fluidically connects in a detachable manner to the hydraulic coupling 62 on the roadway paving vehicle 20. Once connected, the input pump 44 is operable to transfer asphalt binder from the supply truck 22 to the paving vehicle 20 to refill the tank 40.

A further aspect disclosed herein is that the supply tank 142 is disposed vertically beneath the conveyor mechanism 138 and the hopper 134 and between the front wheel set 164 and the rear wheel set 168. The top end of the supply tank 142 is mounted directly to the chassis 126 with brackets 169. This achieves a low center of gravity for the truck 22 particularly when the tank 142 is full and allows for a wider hopper as opposed to side mounting tanks on the walls of the hopper.

In operation, the roadway paving vehicle 20 discharges asphalt binder material and aggregate material over the roadway 12 to chipseal the roadway surface. Specifically, the output pump 48 pumps asphalt binder material from the tank 40 to the spray bar 42 and out through the nozzles 52 to form the asphalt binder layer 14. The output hopper 72 discharges aggregate material through a discharge port 80 to form a layer 16 of aggregate material over the asphalt binder layer 14.

During operation, various control valves 56 and gates 82 can be selectively closed or opened in order to set the width or change the width of the chipsealing operation. This can be done without stopping the vehicle 20. In the event that the vehicle 20 incurs a change in speed, the electronic controller 84 can proportionally control the application flow rates of asphalt binder material and aggregate material to maintain uniform thickness of the layers 14, 16. The flow rate of asphalt binder material can be controlled by adjusting the speed of the pump 48 or the degree of opening of the control valves 54, or both. The flow rate of aggregate material can be controlled by adjusting the degree of opening of the gates 82. The flow rates of aggregate material and asphalt binder are also closely linked to increase and decrease in unison to maintain uniformity of the new chipsealed surface formed from the chipsealing operation.

During operation, the roadway paving vehicle 20 uses its own internal supply of asphalt binder material contained in the tank 40. In addition, the conveyors 88, 89 transport aggregate material from the input hopper 70 to the output hopper 72. Eventually, the supplies contained in the vehicle 20 begin to run out. The supply truck 22 serves to refill the supplies of the roadway paving vehicle 22 and carries a supply of both asphalt binder material and aggregate material. Advantageously, it is not necessary to back up a supply truck as the supply truck can be parked in front of the roadway paving vehicle 20 until the roadway paving vehicle catches up with the supply truck. The supply truck 22 releaseably couples with the roadway paving vehicle 20 while the roadway paving vehicle continues to move forward and discharge asphalt binder material and aggregate material. This advantageously prevents bumps or flaws in the chipsealed roadway. Once coupled, the tailgate doors 144 open to allow aggregate material from the truck hopper 134 to refill the input hopper 70. When the doors 144 open, the transfer conduit 156 also automatically extends rearwardly toward the roadway paving vehicle 20. An operator on the roadway paving vehicle 20 can then couple the transfer conduit 156 to the input conduit 46. An operator can selectively operate the input pump 44 to suction asphalt binder material from the truck supply tank 142 to refill the tank 40 of the roadway paving vehicle 20. Opening of the doors 144 also extends the control module 152 rearward to the roadway paving vehicle 20. An operator on the roadway paving vehicle 20 can use the control module 152 to control the truck conveyer 148 and therefore the refilling rate of the input hopper 70.

After the supply truck 22 is empty, the roadway paving vehicle 20 can be decoupled from the supply truck 22 and linked with a second supply truck 22 identical or similar to the first with a new supply of materials. This also can be done without stopping thereby providing a continuous operation. In practice, fixed location supply stations are often a far distance from the work area and therefore several supply trucks 22 are typically used.

Several additional advantages of the disclosed embodiment can be realized. One advantage is that in many circumstances the roadway 12 can receive traffic in less than an hour after chipsealing, thereby minimizing traffic disturbance. The roadway paving vehicle 20 and supply truck 22 can also occupy one roadway lane, if desired, during chipsealing operations, thereby also minimizing traffic disturbance. The dimensions of the vehicles are sized to be contained within a roadway. The chipsealing process can also operate with a greater viscosity range of asphalt binder material. This advantage can be realized due to the fact that aggregate material can be discharged over the asphalt binder material more quickly in a controlled manner. A viscosity range for asphalt binder material of at least between about 25 and 1000 Saybolt Furol seconds (SFS) at 50° C. is possible. The disclosed embodiment can achieve an application rate of about 10–900 square yards per minute, up to 24 tons per minute of aggregate feed and about 10–400 gallons per minute of asphalt binder material. The roadway paving vehicle can store between about 1 and 100 tons (and preferably between 30 and 25 tons, and even more preferably between 10 and 13 tons) of aggregate material and have a total maximum tank holding capacity of 5,000 gallons (preferably a maximum of 2,000 gallons and even more preferably a maximum of 1,000 gallons). Yet a further advantage is that all of the vehicles 20, 22 of the disclosed embodiment are moving forward during chipsealing operations (in contrast to prior systems where the asphalt dispensing vehicle moved forwardly while the chipspreader moved in reverse to prevent wheels from rolling over asphalt binder material).

It will be appreciated by those skilled in the art that there are several alternative embodiments of the invention. For example, the controls for the truck conveyor can be on the roadway paving vehicle 20 rather than the supply truck 22, such as a remote control system. It is also possible to have the supply truck refill the paving vehicle from the side, however this is less preferred due to the fact two lanes would be occupied. Because no wheels drive over the freshly laid chipsealed roadway surface, less than an average of one layer thick of aggregate material is also a possibility (e.g. only 60% of full cover).

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A supply truck, comprising:

a chassis supported on wheels extending between front and rear ends;

a supply hopper supported by the chassis having a discharge region at the rear end;

a conveyor mechanism in the supply hopper adapted to convey aggregate material towards the discharge region;

a tailgate closing the discharge region of the supply hopper, the tailgate moving rearwardly relative to the chassis to open the discharge region to allow discharge of aggregate material from the rear end of the supply truck;

a supply tank supported by the chassis carrying liquid material;

a transfer conduit carried by the tailgate and connected to the supply tank, the transfer conduit including a hydraulic coupling, the transfer conduit and hydraulic coupling extending rearwardly when the tailgate moves rearwardly; and a support ann mounted to the tailgate, the support arm supporting the transfer conduit and guiding rearward extension of the transfer conduit and hydraulic coupling.

2. The supply truck of claim 1 further comprising:

a control module supported by the support arm and electronically connected to the conveyor mechanism, the control module controlling operation of the conveyor mechanism to control discharge of material from the hopper.

3. The supply truck of claim 2 wherein the tailgate comprises a pair of doors, the doors being pivotably mounted to the hopper such that the doors pivot horizontally outwardly away from each other to open the discharge region and inwardly toward each other to close the discharge region, the support arm being mounted to one of the doors.

4. The supply truck of claim 3 wherein the support arm extends diagonally between vertical and horizontal axes and extends vertically above a vertical top edge of the doors, the control module and hydraulic coupling arranged on the support arm such that the control module and hydraulic coupling extend horizontally rearwardly substantially beyond the doors when the doors are open sufficient to avoid interference with material discharged through the discharge region when the conveyor mechanism is operating.

5. The supply truck of claim 4 further comprising:

means for securing the transfer conduit to the support arm.

6. The supply truck of claim 3 further comprising:

fluid powered cylinders mounted to the hopper controlling the opening and closing of the doors.

7. The supply truck of claim 1 wherein the supply truck is linked to a roadway paving vehicle, the roadway paving vehicle including an operator station, an asphalt binder material dispensing system and an aggregate material dispensing system, the asphalt binder material dispensing system including an asphalt tank and an input conduit connected to the asphalt tank, the input conduit having a hydraulic coupling at the operator station, the hydraulic coupling of the input conduit connecting to the hydraulic coupling of the transfer conduit.

8. A supply truck, comprising:

a chassis supported on wheels extending between front and rear ends;

a supply hopper supported by the chassis having a discharge region at the rear end;

a conveyor mechanism in the supply hopper adapted to convey aggregate material towards the discharge region;

a tailgate closing the discharge region of the supply hopper, the tailgate moving rearwardly relative to the chassis to open the discharge region to allow discharge of aggregate material from the rear end of the supply truck;

a supply tank supported by the chassis carrying liquid material;

a transfer conduit carried by the tailgate and connected to the supply tank, the transfer conduit including a hydraulic coupling, the transfer conduit and hydraulic coupling extending rearwardly when the tailgate moves rearwardly; and wherein the supply truck includes front wheels and rear wheel sets, the supply tank being mounted beneath the conveyor mechanism and the hopper and between the front wheel set and the rear wheel set, whereby a low center of gravity is provided when the tank is filled with liquid.

* * * * *

UNITED STATES PATENT AND TRADEMARK OFFICE

CERTIFICATE OF CORRECTION

PATENT NO. : 6,776,557 B2
DATED : August 17, 2004
INVENTOR(S) : Patrick C. O'Brien et al.

It is certified that error appears in the above-identified patent and that said Letters Patent is hereby corrected as shown below:

Title page,
Item [75], Inventors, delete the following inventors, "James J. Barnat, Jeremy Heller and Tyrone Hannebaum".

Column 11,
Line 14, change "ann" to -- arm --.

Signed and Sealed this

Thirtieth Day of November, 2004

JON W. DUDAS
*Director of the United States Patent and Trademark Office*